United States Patent [19]

Krauss

[11] Patent Number: 4,630,531

[45] Date of Patent: Dec. 23, 1986

[54] BULK SILO

[75] Inventor: Werner Krauss, Hamburg, Fed. Rep. of Germany

[73] Assignee: Claudius Peters AG, Fed. Rep. of Germany

[21] Appl. No.: 760,467

[22] Filed: Jul. 30, 1985

[30] Foreign Application Priority Data

Aug. 3, 1984 [DE] Fed. Rep. of Germany ..... 3429715

[51] Int. Cl.[4] ..... E04H 7/22

[52] U.S. Cl. ..... 98/52; 137/202; 52/192

[58] Field of Search ..... 52/192, 195, 197; 98/55, 119, 52; 137/433, 202; 99/646 S

[56] References Cited

U.S. PATENT DOCUMENTS

| | | | |
|---|---|---|---|
| 2,757,752 | 8/1956 | Kaufman | 137/433 |
| 2,843,146 | 7/1958 | Kirschner | 137/433 |
| 2,871,875 | 2/1959 | Dale | 137/433 |
| 3,196,774 | 7/1965 | Kripal | 98/55 |
| 4,088,149 | 5/1978 | Logsdon | 137/433 |
| 4,129,069 | 12/1978 | Thompson | 99/646 S |

FOREIGN PATENT DOCUMENTS

| | | | |
|---|---|---|---|
| 2849014 | 5/1980 | Fed. Rep. of Germany | 99/656 S |

*Primary Examiner*—Carl D. Friedman
*Assistant Examiner*—Michael Safavi
*Attorney, Agent, or Firm*—Eric P. Schellin

[57] ABSTRACT

Bulk silo with an outlet chamber, from whose upper area a generally open ventilation line runs which is provided with a closing valve for protection against flooding. The closing valve is constructed as a float valve. In order that this closing valve does not become inoperable due to clogging or being inundated with bulk material, its float cage is provided in the area below the float with an aeration device which can be made closed like a plate in order to protect the valve from the direct surge of the material.

4 Claims, 3 Drawing Figures

BULK SILO

BACKGROUND OF THE INVENTION

The invention relates to a bulk silo with an outlet chamber, from whose upper area a generally open ventilation line extends which is provided with a valve part of protection against flooding.

Usually, the ventilation line of silo emptying chambers extends essentially exclusively vertically upward, so that any penetrating bulk material can fall back down and out without clogging the ventilation line (e.g. DE - OS No. 26 19 933). For reasons of stability, such vertical ventilation lines can generally be placed only on the outer wall of the silo, so that they are only suitable for ventilating an outlet chamber located centrally on the silo bottom if a lateral auxiliary chamber is provided between this central chamber and the ventilation line located on the silo wall (e.g. DE - PS No. 26 57 597). The expense for this auxiliary chamber can be avoided if the ventilation line is not positioned so that it rises exclusively vertcially, but rather in some other way, especially falling to an outlet path for the material provided below the silo bottom (e.g. DE - AS No. 28 49 014), which, however, necessitates a valving part in the ventilation line to prevent it from being flooded and to prevent the associated danger of clogging. In the initially cited instance this part is mechanically controlled and only closed if the possibility of flooding the ventilation line is created by closing or occluding the silo outlet, However, the valving parts and the devices for their active control are expensive.

The present invention has the task of creating an inexpensive, operationally safe and easy-to-service device for the protection of a ventilation line which does not rise exclusively vertically.

The present invention solves this task by constructing the closing part as a float valve whose float cage is provided with an aeration device in the area under the float.

Float valves are known in the fluid transfer art, even in the form preferred by the invention, in which the float valve opening is located above the float forming the valve body. It is also known that bulk material can be put in a fluid-like state by means of aeration and that therefore some elements known in the area of fluid transfer can be applied to bulk material fluidized in transfer. However, the use of a float valve for solving the basic problem of the invention was not obvious. The analogy between the transfer of fluids and the transfer of fluidized bulk materials always breaks down when the fluidized state of the bulk material is not assured under all operating conditions and when the smooth operation of the part in question is endangered by the appearance of unfluidized bulk material. When a float valve is used in the outlet chamber of a bulk silo, the appearance of insufficiently fluidized material must be reckoned with for two reasons. Firstly, it is known that a complete fluidization of the material contained in the outlet chamber of a silo can be depended upon only in the ideal situation, namely, in the stationary flow state of easily fluidizable materials, while in the starting state. When the removal of material from the silo is cut off, there is a danger that the air entering at the bottom of the outlet chamber into the material will blow free passageways, so-called rat or blow holes, in the material through which it escapes without fluidizing the material located at the sides of the passageways. There is always the possibility, even in an advanced aeration state, that the totally fluidized mass of material contains agglomerates of unfluidized material. If such unfluidized material passes in the direction of the float cage, it can settle there, block the movement of the float and thus disrupt an orderly operation. Secondly, it must be reckoned with that the fluidized material passing into the float valve will settle there, solidify due to the escape of air contained in it and finally harden, until a smooth operation of the valve becomes questionable.

These dangers avoided by the invention by providing the float cage with an aeration device in the area under the float. This device is not intended to assure that the material reaching this point is sufficiently aerated, because this material had already been fluidized previously in the outlet chamber or can also, if it is a matter of a piece of non-fluidized material, no longer be fluidized in the vehemence of its movement during the brief time of its entry into the float cage by means of the aeration devices provided there. Rather, the invention has recognized that the possibility can simply not be excluded that non-fluidized material will be in the vicinity of the float valve; however, this can be accepted, because the aeration devices assure that this material is subsequently removed, so that no permanent disturbance of the valve will occur.

If there is a sudden rise of the material in the outlet chamber, actuating the float valve, this rise comes primarily from below. It would therefore be obvious to utilize the impulse coming from below, just as in fluid float valves, along with the hydrostatic upward impulse for the closing operation of the float valve. However, the invention disregards this in an advantageous embodiment and makes the float cage closed on its underside in order to achieve the advantage that the particulate material can flow into the float cage only from the side, which reduces the probability that not enough flowable material passes into it.

In the embodiment of the float cage with a closed underside the aeration device is preferably constructed as a porous area provided at the top of the closed undersurface through which porous area compressed air is constantly forced and which is free at the sides for the run-off of the fluidized material on it.

The aeration device of the invention is preferably constantly loaded with compressed air, even if no acute danger of flooding is present. The increased air requirement necessiated by this negligibly small in comparison with that of the other aeration devices of a conventional silo.

BRIEF DESCRIPTION OF THE DRAWINGS

The invention is described in more detail below with reference made to the drawings, which illustrate two advantageous embodiments.

DETAILED DESCRIPTION OF THE INVENTION

Figure 2:
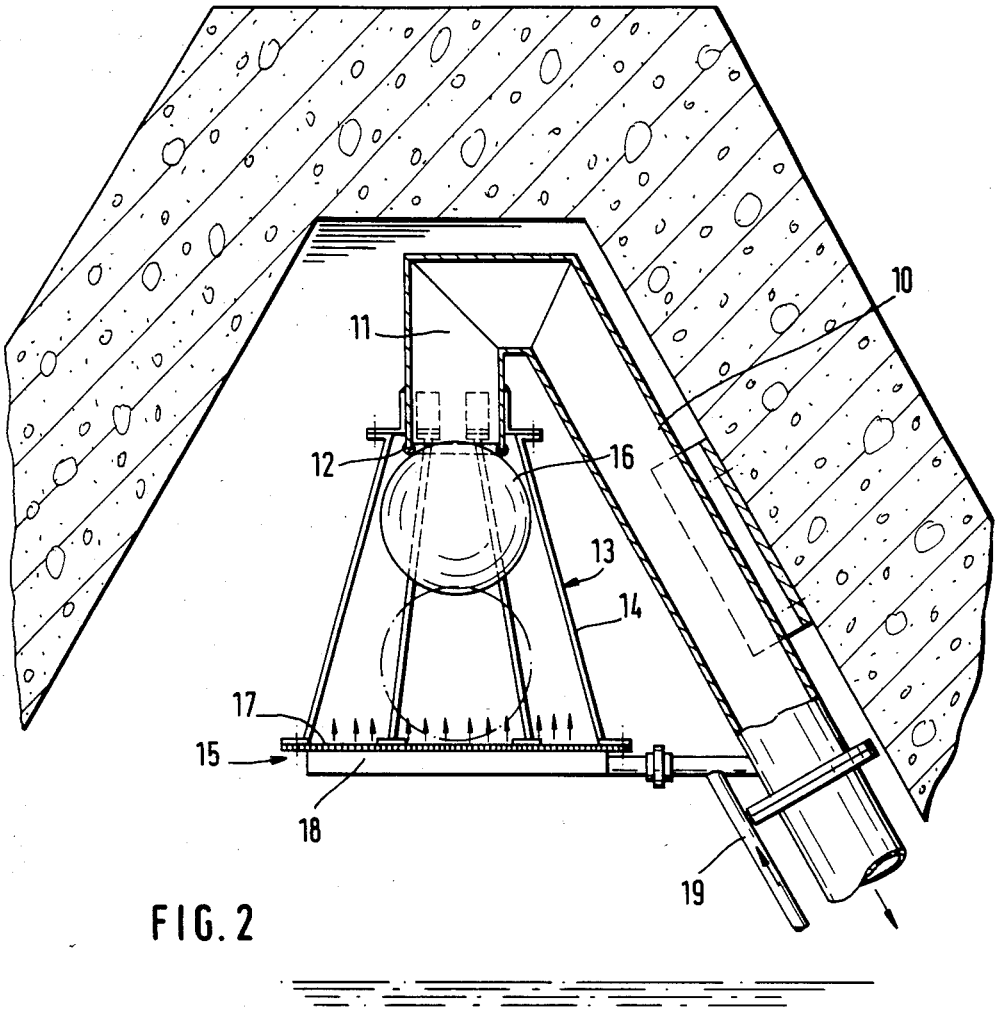
FIG. 2 shows the first embodiment of the float valve in a schematic side view.
Figure 1:
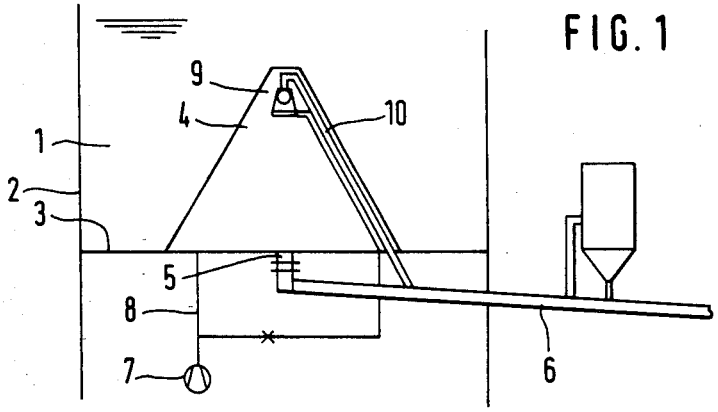
FIG. 1 shows a schematic partial vertical section through the lower section of a silo.

Hollow-cone outlet chamber 4 is located in the center of silo area 1, which is surrounded by walls 2, on silo bottom 3. Outlet 5 is located at the bottom center of this outlet chamber and is connected to outlet line 6, e.g. a pneumatic conveyor trough. The bottom of the outlet chamber is provided with porous loosening elements in a customary manner which are fed by compressor 7 via line 8.

Ventilation line 10 extends downwardly from upper area 9 of outlet chamber 4 to outlet line 6. The upper end of ventilation line 10 is bent vertically down at 11 to form the inlet opening of the ventilation line delimited by circular edge 12. Edge 12 is provided with an elastic rubber sealing ring for a better seal seat in cooperation with the valve body.

Float cage 13 is coaxially fastened to pipe piece 11 of ventilation pipe 10 vertically below it and consists of a plurality of spaced cage rods 14 and cage bottom 15 fastened to them. Ball 16, which functions as a float and valve body, is located inside the cage. The ball diameter is not considerably less than the free cage diameter in its upper area, while it becomes wider further down. Ball 16 is shown in solid lines in the raised closed position and with dotted lines in its position of rest. The cage bottom 15 consists of upper porous plate 17 and compressed air feed chamber 18, which is sealingly connected to its edge, is connected for its part via pipe line 19 to air blower 7 and is preferably constantly supplied by it with compressed air.

In a state of rest, ball 16 rests on plate 15. If the material in chamber 4 rises into upper area 9, it penetrates from the side into cage 13 and raises ball 16 until it closes the inlet opening in cooperation with its edge 12. The material which collected under it in cage 13 can flow out again after the material level has dropped due to the aeration via the porous layer even if it had not been sufficiently fluidized previously.

Figure 3:
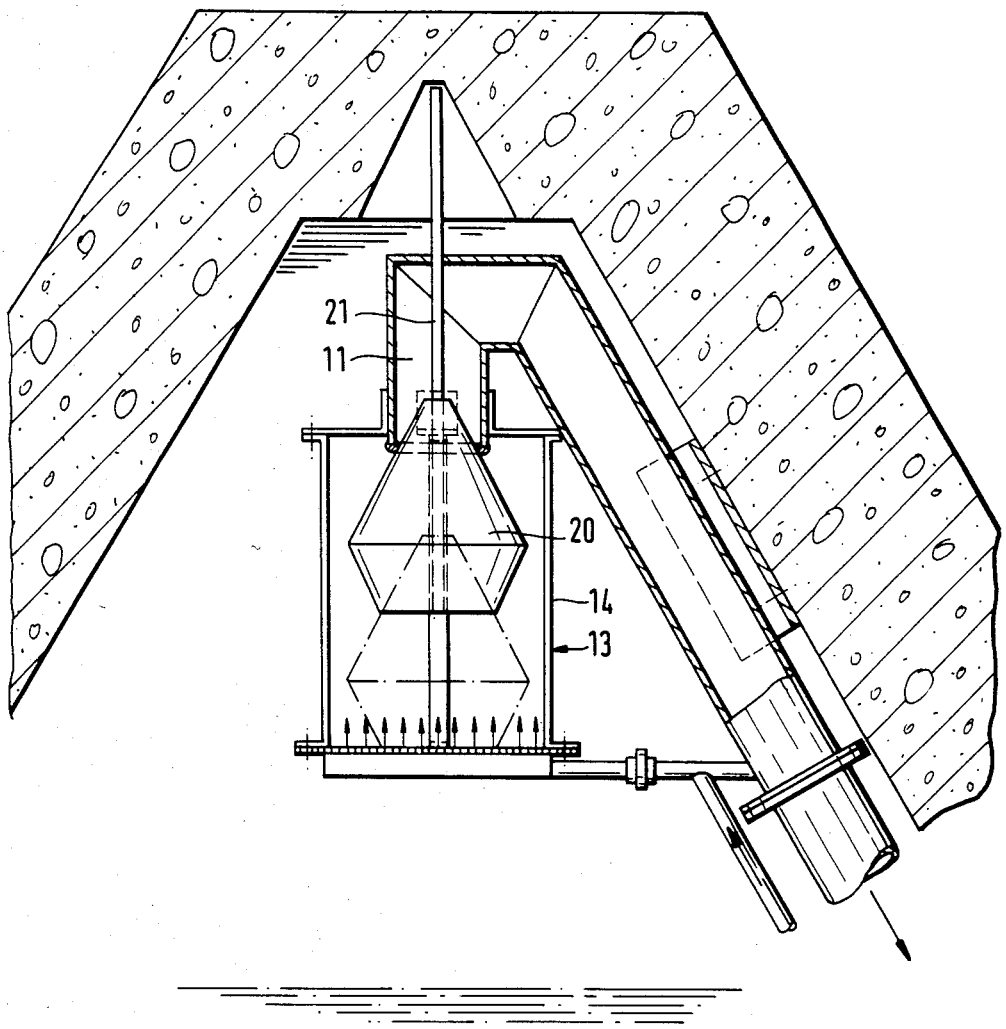
FIG. 3 shows the second embodiment of the float valve in a representation corresponding to FIG. 2.

The embodiment of FIG. 3 differs from that of FIG. 2 in that valve body 20 is constructed as a double cone about a vertical axis and can be vertically shifted with guide rod 21 in guides which are not shown in more detail. In this distance the cage has no guiding function, so that it can exhibit any outer shape desired and the intervals between cage rods 14 can be greater than the diameter of the valve body.

In both embodiments the diameter of plate 15 is considerably greater than the cross-section of valve body 16 or 20, so that it offers a protection to the valve arrangement against material pushing up from below in such a fashion that in any case a clogging of the arrangement due to poorly fluidizing material is not possible. Such material is, rather, forced to enter into the valve arrangement from the side and therefore calmed and at the same time looser, so that there is both a greater probability that even under adverse circumstances the valve body will be driven up sufficiently and also, the pneumatic ability to break up the material which penetrated into the cage by means of the air supplied from porous layer 17 in order to make this material run off is assured.

What is claimed is:

1. In a bulk silo with an outlet chamber having an upper area from which an open non-vertical ventilation line runs, and a closing part for protection against flooding, the improvement comprising a closing part constructed as a float cage (13) surrounding a float valve comprising a float having a given area (16, 20), and a float valve opening edge (12); said cage having an aeration device (17) under the float area within said cage.

2. Silo according to claim 1, wherein the float valve opening edge located above the float is circular, and is provided with an elastic rubber sealing ring.

3. Silo according to claim 2, wherein the float cage has means whereby the float cage is closed on the bottom by a plate (15).

4. Silo according to claim 3, wherein said plate closing the float cage includes an aeration device which directs compressed air upwardly and allows any fluidized material on it to run off; said plate having a diameter with a greater cross-section than the float (16, 20), thereby limiting any particulate material which flows into the float cage to enter only from the side.

* * * * *